United States Patent [19]

Arnold et al.

[11] 4,037,904

[45] July 26, 1977

[54] ELECTRICAL CONNECTOR

[75] Inventors: Bruce K. Arnold, El Toro; Stephen K. Yamamoto, Los Angeles, both of Calif.

[73] Assignee: International Telephone and Telegraph Corporation, New York, N.Y.

[21] Appl. No.: 653,347

[22] Filed: Jan. 29, 1976

[51] Int. Cl.[2] ..... H01R 13/62

[52] U.S. Cl. ..... 339/64 R

[58] Field of Search ..... 339/7, 8, 64–66, 339/211

[56] References Cited

U.S. PATENT DOCUMENTS

| | | | |
|---|---|---|---|
| 2,758,291 | 8/1956 | Richards | 339/211 |
| 2,928,059 | 3/1960 | Chamberlain et al. | 339/65 |
| 3,047,828 | 7/1962 | Gregson et al. | 339/64 R |

FOREIGN PATENT DOCUMENTS

| | | | |
|---|---|---|---|
| 503,405 | 12/1954 | Italy | 339/8 R |
| 727,377 | 3/1955 | United Kingdom | 339/7 |
| 678,392 | 9/1952 | United Kingdom | 339/64 M |

*Primary Examiner*—Joseph H. McGlynn
*Attorney, Agent, or Firm*—Thomas L. Peterson

[57] ABSTRACT

An electrical connector to act as a switch and to provide a fail-safe closure or open indication of a cargo door, wherein first and second telescoping tubes carry a socket and a pin, respectively, and one of the tubes is loosely mounted from the door or a fixed structure in a ball and socket joint.

9 Claims, 6 Drawing Figures

ELECTRICAL CONNECTOR

BACKGROUND OF THE INVENTION

This invention relates to switches, and more particularly to an electrical connector to act as a switch responsive to relative movement between two structures.

Prior art switches of the foregoing type become inoperative or are easily damaged by angular misalignment excessive diametral clearances, axial misalignment of the pin and rigid structural connections.

SUMMARY OF THE INVENTION

The present invention comprises a male electrical split bulbous pin contact mounted inside of a fixed or movable tube. This male pin configuration will mate to a female electrical socket when there is:

a. Angular misalignment;

b. Excessive diametral clearances; and/or c. Axial misalignment due to the construction of the pin mounting.

Mating and unmating may alternately be performed as much as or more than 100,000 cycles.

The male pin can be mounted directly to the tube in an electrically grounded system or be insulated in a two-wire modification. Attachment of the pin to the tube can be made via screws and/or other suitable means.

The female electrical socket includes a metal conductor with a flared hole to engage the male pin. For a "two-wire system," the socket contact can be split and separated with a dielectric. The female socket is housed in a dielectric insulator assembly which has the following features:

a. The engaging end is bulbous shaped to accommodate any angular misalignment;

b. The engaging end has closed entry socket face with a lead in chamfer large enough to guarantee mating;

c. The aft end is more or less elliptically shaped to allow the insulator assembly to "float" and seek its own centerline dependent on any misalignment condition; and d. A pin is fixed to the insulator assembly to prevent rotation, this pin engaging a slot in a mounting plate.

The insulator assembly is fed through a hole in the mounting plate affixed to the applicable mounting surface. The hole is chamfered to allow "float" of the insulator assembly during mating.

Hardware items are used to attach a wire terminal.

The drawing hereof illustrates a single contact system. However, by allowing the individual male contact float, all the concepts disclosed herein apply to a multipin system.

The above-described and other advantages of the present invention will be better understood from the following detailed description when considered in connection with the accompanying drawings.

BRIEF DESCRIPTION OF THE DRAWINGS

In the drawings which are to be regarded as merely illustrative.

DESCRIPTION OF THE PREFERRED EMBODIMENT

Figure 1:
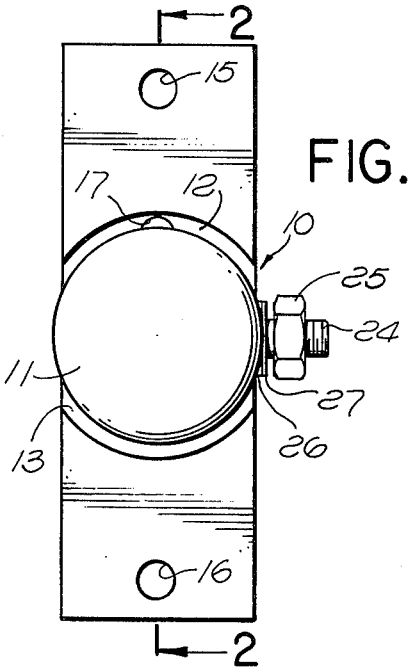
FIG. 1 is a rear elevational view of a connector assembly constructed in accordance with the present invention.

In FIG. 1, an insulator 10 is shown having a bulbous end portion 11 loosely fitted adjacent frustoconical surface portions 12 and 13 in a plate 14 having mounting holes 15 and 16. A keyway 17 is provided in which a locater pin 18 is positioned, as shown in FIG. 2.

If desired, portion 11 of insulator 10 may be a portion of an oblate spheroid.

Figure 2:
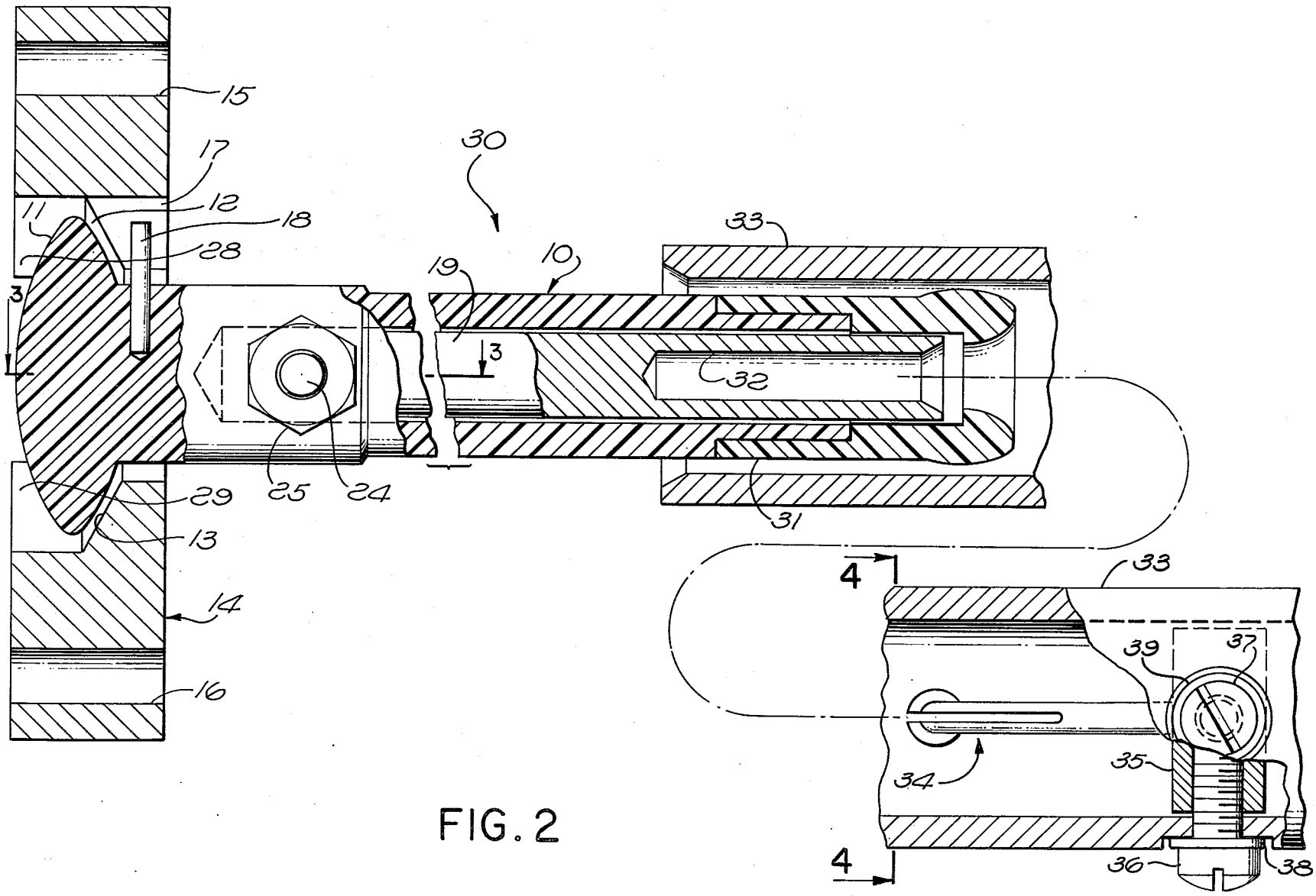
FIG. 2 is a longitudinal sectional view, partly in elevation, of the connector assembly taken on the line 2—2 shown in FIG. 1.

As shown in FIG. 2, pin 18 may be press fit into insulator 10.

Figure 3:
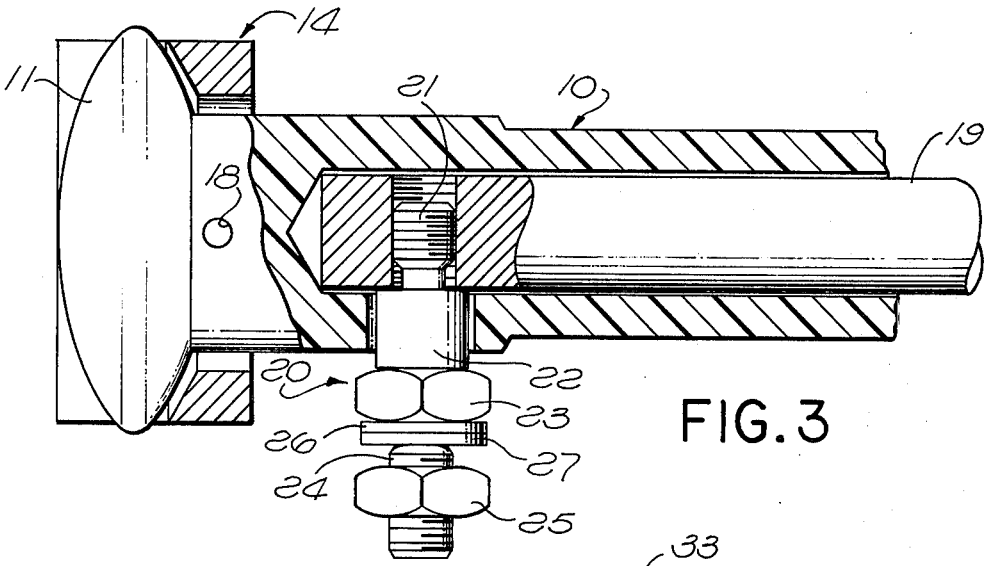
FIG. 3 is a longitudinal sectional view, partly in elevation, of the connector assembly taken on the line 3—3 shown in FIG. 2.

As shown in FIG. 2 and 3, insulator 10 carries, more or less, solid conductor 19 into which a fitting 20 is threaded at 21. Fitting 20 has the threaded portion 21, a shank 22 and a hex head 23, all of which may be solid and integral with one another. Fitting 20 also has a threaded portion 24 onto which nut 25 is threaded. A lock washer is provided at 26. A flat washer is provided at 27.

If desired, nut 25 may be turned in a direction to bring it close to flat washer 27, and a conductive lead may be placed around portion 24 between nut 25 and flat washer 27.

Insulator portion 11 is generally recessed in plate 14. However, if plate 14 is bolted to a wall on the left-hand side of the plate 14, as viewed in FIG. 2, note will be taken that axial movement is permitted of insulator 10, pin 18 being slidable in keyway 12. Furthermore, as shown in FIG. 2, in that position, a plane in the left-hand vertical surface of plate 14 will be tangent to insulator portion 11. In this location, insulator portion 11 will be spaced from frustoconical surface portions 12, and from cylindrical portions 28 and 29. Insulator 10 is included in an assembly 30 having an end portion 31 covering a portion of a socket 32 formed integrally with conductor 19.

Conductive cylinder 33 is provided around the assembly 30 and has a pin 34 fixed to a disk 35 locked by screws 36 and 37 resting on lock washers 38 and 39, respectively.

Figure 5:
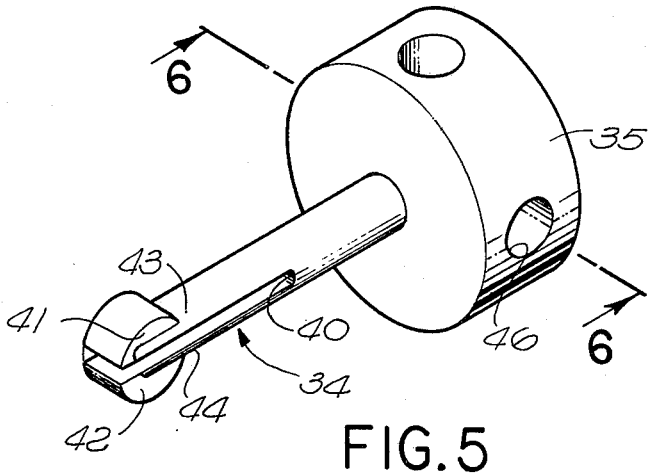
FIG. 5 is a perspective view of a pin assembly shown in FIG. 2.
Figure 4:
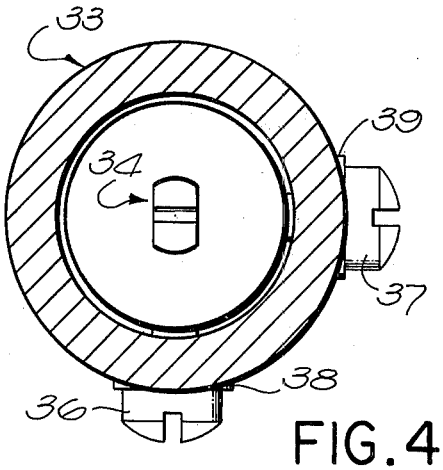
FIG. 4 is a transverse sectional view of the connector assembly taken on the line 4—4 shown in FIG. 2.

As shown in FIGS. 4 and 5, pin 34 has a slot 40 and portion 41 and 42 fixed to spring fingers 43 and 44, respectively, formed by slot 40.

Figure 6:
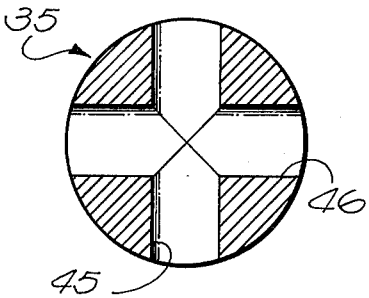
FIG. 6 is a sectional view of pin mounting disk taken on the line 6—6 shown in FIG. 5.

As shown in FIG. 6, disk 35 has passageways 45 and 46 into which screws 36 and 37 are respectively slidable.

What is claimed is:

1. A fail-safe electrical connector for mounting between a fixed structure and a door structure, said connector comprising: a plate for mounting on one of the structures, the plate having a hole therethrough, said hole having a center axis; a hollow tubular insulator assembly connected with said plate and having its longitudinal axis generally coaxial with said center axis but being movable to a position somewhat misaligned therewith; a hollow tubular member having a rearward end fixed to the other structure and a forward end movable toward and said plate; a pin contact having a forward end portion enlarged in at least one dimension transverse to the length of said pin coaxially mounted within said member; said insulator assembly having a forward end and a rear end, said insulator assembly forward end being loosely slidable inside said member forward end, a bore extending through said insulator assembly forward end providing an opening at said insulator assembly forward end; means providing a generally free-floating connection between said rear end of said insulator assembly and said plate, said free-floating connection means allowing variation in the position of said insulator assembly sufficient to accommodate axial and angular misalignment between said center axis and said longitudinal axis; and a socket contact mounted in said bore mating with said pin contact when either one of the structures is moved toward the other.

2. A fail-safe electrical connector as set forth in claim 1, including a terminal in the wall of said member connected to said pin contact, and a second terminal in the wall of said insulator assembly connected to said socket contact.

3. The invention as defined in claim 1, wherein said forward end of said insulator assembly has a generally annular shape and is at least partially enlarged circumferentialy.

4. The invention as defined in claim 1, wherein said pin contact has a curved forward end, and said socket contact has an internally chamfered forward end for guiding said curved forward end of said pin contact into said socket contact.

5. The invention as defined in claim 3, wherein said forward end of said insulator assembly has a partially closed entry over the outer perimeter of said socket contact forward end, said partially closed entry having a lead-in chamfer.

6. The invention as defined in claim 1, wherein said plate has a front surface facing, said member and a rear surface, said hole being countersunk on said rear surface coaxial with said hole, said rear end of said insulator assembly extending loosely through said hole and terminating in an enlarged head positioned in the countersunk portion of said hole.

7. The invention as defined in claim 6, wherein said countersunk portion of said hole has a generally conical configuration, and said head has a rounded surface facing said countersunk portion.

8. A self-aligning electrical connector including first and second mating connector subassemblies for making a positive connection notwithstanding a predetermined combination of angular and lateral misalignments of said mating subassemblies, comprising:

means including first and second mountings movable relatively, each of said mating subassemblies being mechanically attached to a corresponding one of said mountings, and including at least one mechanical ball and socket joint forming said attachment for a predetermined one of said mating subassemblies, said subassemblies being generally arranged for mating and resulting electrical connection therebetween upon relative closure between said mountings;

means within said first subassembly including a generally tubular female conductive member having a flared lead-in entrance section for guiding an imperfectly aligned male connection member inserted therein;

a male connection member within said second subassembly including a generally elongated pin member having an enlarged portion at its outer extremity, said outer extremity being defined as the direction toward said female member prior to mating, said enlarged extremity having at least one dimension transverse with respect to the elongated dimension of said pin which is greater than the largest transverse dimension of said pin, thereby to permit electrical engagement between said enlarged pin extremity and the inside wall of said female member, in said misalignment conditions, the axial centerline of said elongated pin assuming an angular position during said mating which deviates from the axial centerline of said female member.

9. Apparatus according to claim 8 in which said pin member is of resilient conductive material and includes an axial slot extending from and through said outer extremity, said pin member thereby being a bifurcated member capable of resilient deformation to reduce said slot during mating, thereby to maintain a resilient contact force against said female member inside wall.

* * * * *